US006749702B1

(12) United States Patent
Knowlton et al.

(10) Patent No.: US 6,749,702 B1
(45) **Date of Patent: *Jun. 15, 2004**

(54) LOW TEMPERATURE AUTOIGNITION COMPOSITION

(75) Inventors: Gregory D. Knowlton, Chandler, AZ (US); Christopher P. Ludwig, Fountain Hills, AZ (US)

(73) Assignee: Talley Defense Systems, Inc., Mesa, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/010,822

(22) Filed: Jan. 22, 1998

Related U.S. Application Data

(63) Continuation-in-part of application No. 08/645,945, filed on May 14, 1996, now Pat. No. 5,959,242.

(51) Int. Cl.[7] ..... C06B 33/08

(52) U.S. Cl. ..... 149/38; 149/37; 149/43; 149/45; 102/205

(58) Field of Search ..... 102/205; 149/37, 149/38, 43, 45, 41, 40

(56) References Cited

U.S. PATENT DOCUMENTS

| | | | | | |
|---|---|---|---|---|---|
| 1,964,077 | A | * | 6/1934 | Piccard | 149/45 |
| 2,008,366 | A | * | 7/1935 | Pickett | 149/43 |
| 2,981,616 | A | * | 4/1961 | Boyer | 149/37 |
| 3,017,301 | A | * | 1/1962 | Engelhardt | 149/45 |
| 3,028,229 | A | * | 4/1962 | Olander | 149/40 |
| 3,053,710 | A | * | 9/1962 | Osborn et al. | 149/76 |
| 3,175,979 | A | * | 3/1965 | Markowitz | 149/77 |
| 3,269,879 | A | * | 8/1966 | Stammler et al. | 149/46 |
| 3,370,537 | A | * | 2/1968 | Tepper | 149/43 |
| 3,418,184 | A | * | 12/1968 | Vetter | 149/42 |
| 3,609,115 | A | | 9/1971 | Sammons | 260/32.4 |
| 3,837,938 | A | * | 9/1974 | Haury et al. | 149/40 |
| 3,883,373 | A | * | 5/1975 | Sidebottom | 149/43 |
| 3,890,174 | A | | 6/1975 | Helms, Jr. et al. | 149/44 |
| 4,179,327 | A | * | 12/1979 | Seldner | 149/3 |
| 4,238,253 | A | * | 12/1980 | Garner | 149/19.6 |
| 4,248,644 | A | * | 2/1981 | Healy | 149/45 |
| 4,632,714 | A | * | 12/1986 | Abegg et al. | 149/45 |
| 4,756,776 | A | * | 7/1988 | Halliday et al. | 149/2 |
| 4,861,397 | A | * | 8/1989 | Hillstrom | 149/19.4 |
| 5,026,442 | A | * | 6/1991 | Yabsley et al. | 149/21 |
| 5,035,757 | A | * | 7/1991 | Poole | 149/45 |
| 5,380,380 | A | * | 1/1995 | Poole et al. | 149/45 |
| 5,429,691 | A | | 7/1995 | Hinshaw et al. | 149/45 |
| 5,431,103 | A | * | 7/1995 | Hock et al. | 102/287 |
| 5,439,537 | A | | 8/1995 | Hinshaw et al. | 149/22 |
| 5,482,579 | A | | 1/1996 | Ochi et al. | 149/83 |
| 5,514,230 | A | * | 5/1996 | Khandhadia | 149/36 |
| 5,538,567 | A | | 7/1996 | Henry, III et al. | 149/18 |
| 5,542,688 | A | | 8/1996 | Scheffee | 280/741 |
| 5,551,725 | A | * | 9/1996 | Ludwig et al. | 280/741 |
| 5,847,315 | A | * | 12/1998 | Katzakian et al. | 149/46 |
| 5,858,460 | A | * | 1/1999 | Ferrando et al. | 427/217 |
| 5,959,242 | A | * | 9/1999 | Knowlton et al. | 149/38 |

OTHER PUBLICATIONS

Ellern, Military and Civilian Pyrotechnics, pp 41, 46, 271, 284–288, 294–300, Chemical Publishing Company (1968) New York.*

Vogelsanger et al., Chemical Abstracts, (1995) Abstract No. 124:33072.*

Ruschev, Chemical Abstracts, (1966) Abstract No. 66:4779.*

Block–Bolten et al., Chemical Abstracts, (1988) Abstract No. 109:76237.*

* cited by examiner

*Primary Examiner*—Aileen B. Felton
(74) *Attorney, Agent, or Firm*—Fitzpatrick, Cella, Harper & Scinto

(57) ABSTRACT

The present invention relates to a low temperature autoignition composition for safely initiating combustion of a main pyrotechnic charge in a gas generator or pyrotechnic device exposed to flame or a high temperature environment. The low temperature autoignition compositions of the invention include a mixture of an oxidizer and a powdered metal, wherein the oxidizer includes silver nitrate or a comelt or mixture comprising silver nitrate and at least one of an alkali metal nitrate, an alkaline earth metal nitrate, a complex salt nitrate, a dried, hydrated nitrate, an alkali metal chlorate, an alkali metal perchlorate, an alkaline earth metal chlorate, an alkaline earth metal perchlorate, ammonium perchlorate, sodium nitrite, potassium nitrite, silver nitrite, a complex salt nitrite, a solid organic nitrate, a solid organic nitrite, or a solid organic amine, and where the metal fuel and oxidizer are present in amounts sufficient to provide an autoignition composition having an autoignition temperature of no more than about 232° C. The present invention also relates to a method for initiating a gas generator or pyrotechnic composition in a gas generator or pyrotechnic device exposed to flame or a high temperature environment. In the method of the invention, the gas generator or pyrotechnic composition is placed in thermal contact with a low temperature autoignition composition of the invention.

31 Claims, No Drawings

LOW TEMPERATURE AUTOIGNITION COMPOSITION

This application is a continuation-in-part of U.S. application Ser. No. 08/645,945, filed on May 14, 1996 now U.S. Pat. No. 5,959,242.

FIELD OF THE INVENTION

The invention relates to gas generating compositions, such as those used in "air bag" passive restraint systems, and, in particular, to autoignition compositions that provide a means for initiating combustion of a main pyrotechnic charge in a gas generator or pyrotechnic device exposed to temperatures significantly above the temperatures at which the unit is designed to operate.

BACKGROUND OF THE INVENTION

One method commonly used for inflating air bags in vehicle passive restraint systems involves the use of an ignitable gas generator that generates an inflating gas by an exothermic reaction of the components of the gas generator composition. Because of the nature of passive restraint systems, the gas must be generated, and the air bag deployed in a matter of milliseconds. For example, under representative conditions, only about 60 milliseconds elapse between primary and secondary collisions in a motor vehicle accident, i.e., between the collision of the vehicle with another object and the collision of the driver or passenger with either the air bag or a portion of the vehicle interior.

In addition, the inflation gas must meet several stringent requirements. The gas must be non-toxic, non-noxious, must have a generation temperature that is low enough to avoid burning the passenger and the air bag, and it must be chemically inert so that it is not detrimental to the mechanical strength or integrity of the bag.

The stability and reliability of the gas generator composition over the life of the vehicle are also extremely important. The gas generator composition must be stable over a wide range of temperature and humidity conditions, and must be resistant to shock, so that it is virtually impossible for the gas generator to be set off except when the passive restraint system is activated by a collision.

Typically, the inflation gas is nitrogen, which is produced by the decomposition reaction of a gas generator composition containing a metal azide. One such gas generator composition is disclosed in Reissued U.S. Pat. No. Re. 32,584. The solid reactants of the composition include an alkali metal azide and a metal oxide, and are formulated to ignite at an ignition temperature of over about 315° C.

The gas generator composition is typically stored in a metal inflator unit mounted in the steering wheel or dashboard of the vehicle. Several representative inflator units are disclosed in U.S. Pat. Nos. 4,923,212, 4,907,819, and 4,865,635. The combustion of the gas generator composition in these devices is typically initiated by an electrically activated initiating squib, which contains a small charge of an electrically ignitable material, and is connected by electrical leads to at least one remote collision sensing device.

Due to the emphasis on weight reduction for improving fuel mileage in motorized vehicles, inflator units are often formed from light weight materials, such as aluminum, that can lose strength and mechanical integrity at temperatures significantly above the normal operating temperature of the unit. Although the temperature required for the unit to lose strength and mechanical integrity is much higher than will be encountered in normal vehicle use, these temperatures are readily reached in, for example, a vehicle fire. As the operating pressure of standard pyrotechnics increases with increasing temperature, a gas generator composition at its autoignition temperature will produce an operating pressure that is too high for a pressure vessel that was designed for minimum weight. Moreover, the melting point of many non-azide gas generator compositions is low enough for the gas generator composition to b molten at the autoignition temperature of the composition, which can result in a loss of ballistic control and excessive operating pressures. Therefore, in a vehicle fire, th ignition of the gas generator composition can result in an explosion in which fragments of the inflation unit are propelled at dangerous and potentially lethal velocities.

To prevent such explosions, air bags have typically included an autoignition composition that will autoignite and initiate the combustion of the main gas generating pyrotechnic charge at a temperature below that at which the shell or housing begins to soften and lose structural integrity. The number of autoignition compositions available in the prior art is limited, and includes nitrocellulose and mixtures of potassium chlorate and a sugar. However, nitrocellulose decomposes with age, so that the amount of energy released upon autoignition decreases, and may become insufficient to properly ignite the main gas generator charge. Moreover, prior art autoignition compositions have autoignition temperatures that are too high for some applications, e.g., non-azide auto air bag main charge generants.

Therefore, a need exists for a stable autoignition composition that is capable of igniting the gas generator composition at a temperature that is sufficiently low that the inflator unit maintains mechanical integrity at the autoignition temperature, but which is significantly higher than the temperatures reached under normal vehicle operating conditions.

SUMMARY OF THE INVENTION

The present invention relates to an autoignition composition for safely initiating combustion in a main pyrotechnic charge in a gas generator or pyrotechnic device exposed to flame or a high temperature environment. The autoignition compositions of the invention comprise a mixture of an oxidizer and a powdered metal fuel, where the oxidizer comprises at least one of an alkali metal or an alkaline earth metal nitrate, a complex salt nitrate, such as $Ce(NH_4)_2(NO_3)_6$ or $ZrO(NO_3)_2$, a dried, hydrated nitrate, such as $Ca(NO_3)_2 \cdot 4H_2O$ or $Cu(NO_3)_2 \cdot 2.5\ H_2O$, silver nitrate, an alkali or alkaline earth metal chlorate or perchlorate, ammonium perchlorate, a nitrite of sodium, potassium, or silver, or a solid organic nitrate, nitrite, or amine, such as guanidine nitrate, nitroguanidine and 5-aminotetrazole, respectively. Preferably, the oxidizer comprises silver nitrate or a comelt or mixture comprising silver nitrate and at least one of an alkali metal nitrate, an alkaline earth metal nitrate, a complex salt nitrate, a dried, hydrated nitrate, an alkali metal chlorate, an alkali metal perchlorate, an alkaline earth metal chlorate, an alkaline earth metal perchlorate, ammonium perchlorate, sodium nitrite, potassium nitrite, silver nitrite, a complex salt nitrite, a solid organic nitrate, a solid organic nitrite, or a solid organic amine, and the metal fuel and oxidizer are present in amounts sufficient to provide an autoignition composition having an autoignition temperature of no more than about 232° C.

Typically, the autoignition temperature, the temperature at which the autoignition compositions of the invention spontaneously ignite or autoignite, is between about 80° C. and about 232° C. To obtain the desired autoignition temperature, the autoignition compositions of the invention may further comprise an alkali or alkaline earth chloride, fluoride, or bromide comelted with a nitrate, nitrite, chlorate, or perchlorate, such that the autoignition composition has a eutectic or peritectic in the range of about 80° C. to about 250° C. In addition, for compositions with low output energy, an output augmenting composition, which comprises an energetic oxidizer of ammonium perchlorate or an alkali metal chlorate, perchlorate or nitrate, in combination with a metal, may be added to the composition.

Preferred autoignition compositions include oxidizers of a comelt of silver nitrate and alkali metal or alkaline metal nitrates, nitrites, chlorates or perchlorates, or a nitrite of sodium, potassium, or silver, and mixtures of silver nitrate and solid organic nitrates, nitrites, or amines.

The powdered metals useful as fuel in the present invention include molybdenum, magnesium, calcium, strontium, barium, titanium, zirconium, vanadium, niobium, tantalum, chromium, tungsten, manganese, iron, cobalt, nickel, copper, zinc, cadmium, tin, antimony, bismuth, aluminum, cerium, and silicon. It should be noted that molybdenum appears to be unique in its reactivity with the oxidizers described above, and is therefore the preferred metal fuel.

The most preferred inorganic autoignition compositions include comelts of silver nitrate and potassium nitrate, mixed with powdered molybdenum metal. In such an autoignition composition, the comelt is ground to a particle size of about 10 to about 30 microns, and the molybdenum powder has a particle size of less than about 2 microns. The mole fraction of silver nitrate in the comelt is typically about 0.4 to about 0.6, the mole fraction of potassium nitrate in the comelt is about 0.6 to 0.4, and the comelt is mixed with at least a stoichiometric amount of molybdenum powder.

The most preferred organic autoignition compositions include a mixture of silver nitrate, guanidine nitrate, and molybdenum. In such an autoignition composition, the amount of molybdenum may be varied to adjust the autoignition temperature. If the amount of molybdenum is greater than the stoichiometric amount, the autoignition temperature of the autoignition composition will decrease as the amount of molybdenum is increased.

The present invention also relates to a method for safely initiating combustion of a gas generator or pyrotechnic composition in a gas generator or pyrotechnic device having a housing when the gas generator or pyrotechnic device is exposed to flame or a high temperature environment. The method of the invention comprises forming an autoignition composition, as described above, and placing the autoignition composition in thermal contact with the gas generator or pyrotechnic composition within the gas generator or pyrotechnic device, such that the autoignition composition autoignites and initiates combustion of the gas generator or pyrotechnic composition when the gas generator or pyrotechnic device is exposed to flame or a high temperature environment. The method of the invention may also include the step of mixing the autoignition composition with an output augmenting composition, as described above, such that the autoignition composition autoignites and initiates combustion of the output augmenting composition, which, in turn, initiates combustion of the gas generator or pyrotechnic composition when the gas generator or pyrotechnic device is exposed to flame or a high temperature environment.

DETAILED DESCRIPTION OF THE INVENTION

The autoignition compositions of the invention are suitable for use with a variety of gas generating and pyrotechnic devices, in particular, vehicle restraint system air bag inflators. The autoignition compositions ensure that the gas generating or pyrotechnic device functions properly and safely when exposed to a high temperature environment, i.e., that combustion of the main pyrotechnic charge is initiated at a temperature below the temperature at which the material used to form the shell or housing begins to weaken or soften. If the autoignition composition is not utilized, the device may not function properly or safely if exposed to high heat or flame, because the operating pressure of standard pyrotechnics increases with increasing temperature. Therefore, a gas generator composition at its autoignition temperature can produce an operating pressure that is too high for a pressure vessel that was designed for minimum weight. Moreover, the melting point of many non-azide gas generator compositions is low enough for the gas generator composition to be molten at the autoignition temperature of the composition, which can result in a loss of ballistic control and excessive operating pressures. As a result, under high temperature conditions the components of the gas generator or pyrotechnic composition within the device can decompose, melt, or sublim, and burn at an accelerated rate, resulting in an xplosion that would d stroy the device, and could possibly propel harmful or lethal fragments. The autoignition compositions of the invention provide an effective means for preventing such a catastrophic occurrence.

The pyrotechnic autoignition compositions of the invention provide several advantages over typical autoignition materials currently in use, such as nitrocellulose, including a lower autoignition temperature and better thermal stability. The preferred compositions autoignite over a narrow temperature range, and provide extremely repeatable performance. The complete series of compositions described and claimed herein have a wide range of autoignition temperatures that can be tailored for particular applications. The autoignition compositions also may have low to moderate hazard sensitivities, i.e., DOT 1.3c or lower.

The autoignition compositions of the invention comprise a mixture of a powdered metal fuel and an oxidizer of one or more alkali metal or alkaline earth metal nitrates, silver nitrate, alkali or alkaline earth metal chlorates or perchlorates, ammonium perchlorate, nitrites of sodium, potassium, or silver, or a complex salt nitrate, such as ceric ammonium nitrate, $Ce(NH_4)_2(NO_3)_6$, or zirconium oxide dinitrate, $ZrO(NO_3)_2$. As used herein, the term "powdered metal" encompasses metal powders, particles, prills, flakes, and any other form of the metal that is of the appropriate size and/or surface area for use in the present invention, i.e., typically, with a dimension of less than about 100 microns. When more than one oxidizer is used in the composition, they may be provided either as a mixture or a comelt. Comelts have eutectics and/or peritectics in the range of about 80° to 250° C.

Solid organic nitrates, $R—(ONO_2)_x$, nitrites, $R—(NO_2)_x$, and amines $R—(NH_2)_x$, can also be used as the oxidizer component, either alone or in combination with one or more other solid organic nitrate, nitrite, or amine, or with on or mor of the inorganic nitrates, nitrites, chlorates or perchlorates listed above, but preferably only as mechanical mixes because in some cases comelts of these solid organic materials with inorganic/organic oxidizers may produce unstable combinations. Preferably the solid organic nitrates, nitrites and amines that are useful in forming the autoignition compositions of the invention have melting points between about 80° C. and about 250° C. When heated, mixtures should preferably produce eutectics and peritectics in the range of about 80° C. to about 250° C. These mixtures may be combined with one or more of the metals disclosed herein, and can be used in a powdered, granular or pelletized form.

It has also been determined using selected hydrated metal nitrates, such as $Ca(NO_3)_2 \cdot 4H_2O$ and $Cu(NO_3)_2 \cdot 2.5\ H_2O$, that hygroscopic, low melting point metal nitrates can be dehydrated and stabilized relative to moisture absorption by comelting with anhydrous metal nitrates, such as those described above. It is believed that many other low melting point, hydrated metal nitrates of the general formula $M(NO_3)_x \cdot YH_2O$, including, but not limited to, the nitrates of chromium, manganese, cobalt, iron, nickel, zinc, cadmium, aluminum, bismuth, cerium and magnesium, can also be dehydrated and stabilized relative to moisture absorption and rehydration by comelting with anhydrous metal nitrates, nitrites, chlorates and/or perchlorates. These comelts can be combined with metals to produce low temperature (80° C. to 250° C.) autoignition compositions.

The output energy of certain autoignition compositions taught herein, in particular, certain nitrate/nitrite/metal systems, is very low, and may not be sufficient to ignite the ignition enhancer or ignition booster charge. Autoignition compositions of this type may require an output augmenting material or charge to initiate combustion of the enhancer and main pyrotechnic charge. The ignition train for such a composition is initiated when the autoignition composition is heated to the autoignition temperature and ignites. The heat generated by the combustion of the autoignition device ignites the output augmenting material, which, in turn, ignites the enhancer and main pyrotechnic charge of the gas generator. The augmentation material can be a charge which is separate from the autoignition material, or is mixed in with the autoignition composition to boost its output. Typically, an output augmenting composition comprises an energetic oxidizer, such as ammonium perchlorate or alkali metal chlorate, perchlorate or nitrate, and a metal such as Mg, Ti, or Zr or a nonmetal such as boron.

In addition, the presence of certain metal oxides in a nitrate, nitrite, chlorate or perchlorate oxidizer mix or comelt of the invention can have a catalytic effect in lowering the autoignition temperature for the reaction of the oxidizer and the metal, which is equivalent to lowering the energy of activation. Metal oxides useful in the invention for this purpose include, but are not limited to $Al_2O_3$, $SiO_2$, $CeO_2$, and transition metal oxides, which include, but are not limited to $V_2O_5$, $CrO_3$, $Cr_2O_3$, $MnO_2$, $Fe_2O_3$, $Co_3O_4$, NiO, CuO, ZnO, $ZrO_2$, $Nb_2O_5$, $MoO_3$, and $Ag_2O$.

In the autoignition compositions of the invention, the nitrate, nitrite, chlorate or perchlorate component or components function as an oxidizer, and the metal serves as a fuel. For example, the reaction of a composition comprising a comelt of metal nitrates and a metal proceeds according to the general equation $$(\text{Metal}_1\text{Nitrate}+\text{Metal}_2\text{Nitrate})_{(comelt)}+\text{Metal}_3 \rightarrow \text{Metal}_1\text{Oxide}+\text{Metal}_2\text{Oxide}+\text{Metal}_3\text{Oxide}+\text{Nitrogen} \quad \text{(I)}$$

The driving force for this reaction appears to follow the activity series or electromotive series for metals, in which metallic elements higher in the series will displace, i.e., reduce, elements lower in the series from a solution or melt. In particular, oxidizer systems containing silver nitrate and/or silver nitrite will generally yield very efficient autoignition materials with respect to ease, rate, and intensity of reaction when compounded with metals which are high in the activity or electromotive series. For example, Mg, Al, Mn, Zn, Cr, Fe, Cd, Co, Ni and Mo are all well above Ag in the series. A typical reaction is represented by equations II to V.

$$2AgNO_3+Mg \rightarrow 2Ag+Mg(NO_3)_2 \quad \text{(II)}$$

In this high temperature, molten salt environment neither the $Mg(NO_3)_2$ nor the Ag metal are stable, and a second reaction quickly occurs to produce metal and nitrogen oxides:

$$2Ag+Mg(NO_3)_2 \rightarrow Ag_2O+MgO+2NO_2. \quad \text{(III)}$$

When potassium nitrate is also present in the comelt, the following reaction also occurs.

$$9Mg+2KNO_3+2NO_2 \rightarrow K_2O+9MgO+2N_2 \quad \text{(IV)}$$

Summing equations II, III, and IV, yields a net reaction that was given in general terms as equation I. For a composition of silver nitrate, potassium nitrate and magnesium, the net reaction is.

$$2AgNO_3+2KNO_3+10Mg \rightarrow Ag_2O+K_2O+10MgO+2N_2. \quad \text{(V)}$$

A comparison of Differential Scanning Calorimeter (DSC) and Calibrated Tube Furnace autoignition test results for inorganic, organic and mixed inorganic/organic nitrate, nitrite, chlorate and perchlorate oxidizer systems with selected metals, demonstrates that at least two different autoignition mechanisms may be involved. As described above, purely inorganic systems, e.g., $KNO_3/AgNO_3/Mo$, generally autoiqnite in the vicinity of a thermal event clearly visible on a DSC scan, such as a crystallin phase transition, a melting point, or a eutectic or peritectic point. In some of the organic and mixed inorganic/organic systems it appears that autoignition of larger mass samples in the tube furnace can occur at much lower temperature than autoignition in the DSC without the presence of some small, lower temperature thermal event observed on the DSC. For example, the $CH_6N_4O_3/AgNO_3/Mo$ system autoignites at 170–174° C. by DSC analysis with no visible thermal events prior to autoignition. However, a 200 mg sample of the same composition autoignites in the tube furnace at 138–158° C., depending on percent composition. It is possible that this is more than just a mass effect, and the dramatic reduction in autoignition temperatures observed in tube furnace testing, as compared to the results obtained with DSC testing, is possibly the result of some catalytic, self heating, or other thermal effect.

The amount of the nitrate, nitrite, chlorate or perchlorate used in an autoignition composition can vary significantly. For purely inorganic systems, the mole percent or molar ratio of the nitrate, nitrite, chlorate or perchlorate oxidizer components in binary and ternary mixes and comelts should be stoichiometrically balanced with the metal or metals in the final autoignition composition, i.e., the molar amounts of the oxidizer and metal fuel are substantially proportional to the molar amounts given in the balanced chemical equation for the reaction of the oxidizer with the fuel. However, it appears that the autoignition temperature for organic/inorganic compositions comprising molybdenum metal can be tailored by adjusting the molybdenum metal content from stoichiometrically balanced to extremely metal (fuel) rich. As the molybdenum metal content is increased the autoignition temperature decreases. It is believed that this holds true for the other metal fuels described above.

The amount of each oxidizer component in a mixture or comelt depends on the molar amounts of the oxidizers at or near the eutectic point for the specific oxidizer mixture or comelt composition. As a result the nitrate, nitrite, chlorate or perchlorate oxidizer component or components will be the major component in some autoignition compositions of the invention, and the powdered metal fuel will be the major component in others. Those skilled in the art will be able to determine the required amount of each component from the stoichiometry of the autoignition reaction or by routine experimentation.

The preferred compositions comprise a comelt of silver nitrate, $AgNO_3$, and a nitrate of an alkali metal or an alkaline earth metal, preferably, lithium nitrate, $LiNO_3$, sodium nitrate, $NaNO_3$, potassium nitrate, $KNO_3$, rubidium nitrate, $RbNO_3$, cesium nitrate, $CsNO_3$, magnesium nitrate, $Mg(NO_3)_2$, calcium nitrate, $Ca(NO_3)_2$, strontium nitrate, $Sr(NO_3)_2$, or barium nitrate, $Ba(NO_3)_2$, a nitrite of sodium, $NaNO_2$, potassium, $KNO_2$, and silver, $AgNO_2$, a chlorate of an alkali metal or an alkaline earth metal, preferably lithium chlorate, $LiClO_3$, sodium chlorate, $NaClO_3$, potassium chlorate, $KClO_3$, rubidium chlorate, $RbClO_3$, calcium chlorate, $Ca(ClO_3)_2$, strontium chlorate, $Sr(ClO_3)_2$, or barium chlorate, $Ba(ClO_3)_2$, or a perchlorate of an alkali metal or an alkaline earth metal, preferably lithium perchlorate, $LiClO_4$, sodium perchlorate, $NaClO_4$, potassium perchlorate, $KClO_4$, rubidium perchlorate, $RbClO_4$, cesium perchlorate, $CsClO_4$, magnesium perchlorate, $Mg(ClO_4)_2$, calcium perchlorate, $Ca(ClO_4)_2$, strontium perchlorate, $Sr(ClO_4)_2$, or barium perchlorate, $Ba(ClO_4)_2$. Preferred compositions also include mixtures of $AgNO_3$ and the solid organic nitrate guanidine nitrate, $CH_6N_4O_3$.

The preferred metal fuels are molybdenum, Mo, magnesium, Mg, calcium, Ca, strontium, Sr, barium, Ba, titanium, Ti, zirconium, Zr, vanadium, V, niobium, Nb, tantalum, Ta, chromium, Cr, tungsten, W, manganese, Mn, iron, Fe, cobalt, Co, nickel, Ni, copper, Cu, zinc, Zn, cadmium, Cd, tin, Sn, antimony, Sb, bismuth, Bi, aluminum, Al, cerium, Ce, and silicon, Si. These metals may be used alone or in combination.

The most preferred metal fuel, molybdenum, appears to be unique in its reactivity with nitrate, nitrite, chlorate and perchlorate salts, mixes and comelts. Molybdenum metal has reacted and autoignited with every oxidizer and oxidizer system of nitrates, nitrites, chlorates and perchlorates tested. Although the mechanism is not fully understood, there appears to be a sensitizing or catalytic interaction between molybdenum and nitrates, nitrites, chlorates and perchlorates.

The binary and ternary oxidizer systems can be mixed by physical or mechanical means, or can be comelted to produce a higher level of ingredient intimacy in the mix. Repetitive comelting, preferably 2 to about 4 times, produces the highest level of ingredient intimacy and mix homogeneity. The oxidizers in mechanical mixes should each be ground to an average particle size (APS) of about 100 microns or less prior to mixing, preferably about 5 to about 20 microns. Comelts of oxidizers should also be ground to less than about 100 microns APS, again, with a preferred APS of about 5 to about 20 microns. Average particle size of the metals used in the autoignition compositions should be about 35 microns or less with the preferred APS being less than about 10 microns. The reaction or burning rate and ease of autoignition increases as mix intimacy and homogeneity increases, and as the average particle size of the oxidizers and metals decreases. In other words, reaction rate and ease of autoignition are proportional to mix intimacy and homogeneity and inversely proportional to the average particle size of the oxidizer and metal components.

The most preferred purely inorganic composition is a comelt of silver nitrate and potassium nitrate, ground to a particle size of about 20 microns, mixed with powdered molybdenum having a particle size of less than about 2 microns. The mole fraction of silver nitrate in the comelt is from about 0.4 to about 0.6, and the mole fraction of potassium nitrate is from about 0.6 to about 0.4. The composition further comprises an essentially stoichiometric amount of molybdenum.

The autoignition temperature can be adjusted and tailored for specific uses by varying the amounts and types of the metal nitrates in the comelt and the specific metal used. The most preferred compositions of $AgNO_3/KNO_3/Mo$ have an autoignition temperature between 130° and 135° C.

For the majority of the compositions described herein, autoignition appears to occur very near a phase change. For example, a melting or crystal structure rearrangement of one of the oxidizers in a mechanical mix, or of the single oxidizer in simpler systems. In binary and ternary comelt systems, autoignition occurs near a eutectic or peritectic point. In all of the cases described above, the oxidizer softens or melts producing a kinetically favorable environment for reaction with the metal.

Each system of comelted oxidizers is unique. A simple binary system can have a single eutectic point, as described by the phase diagram of the system, that results in a single autoignition temperature for a specific metal/comelt composition. For example, a binary comelt of $LiNO_3/KNO_3$ with molybdenum will autoignite at 230° C.

Other more complicated binary and ternary comelts can have eutectic and peritectic points that result in several different autoignition temperatures for a specific metal/comelt system. The autoignition temperature of the composition is dependent on the molar ratio of the oxidizers in the comelt. For example, a binary comelt of $AgNO_3/KNO_3$ with molybdenum has an autoignition temperature near the peritectic point of 135° C. for comelts with less than 58 mole percent $AgNO_3$, based on the weight of the comelt, but has an autoignition temperature near the eutectic point of 118° C. for comelts with 58 mole percent $AgNO_3$ or higher.

The eutectic and peritectic melting points of a binary system tends to set the upper limit for any ternary system containing the specific binary combination of oxidizers. In other words, the melting point or eutectic of a ternary system cannot be higher than the lowest melting point of a binary combination within it.

In some cases certain non-energetic salts such as alkali and alkaline earth chlorides, fluorides and bromides can be comelted with selected nitrates, nitrites, chlorates and perchlorates, preferably $AgNO_3$ and $AgNO_2$, to produce eutectics or peritectics preferably in the range of about 80° C. to about 250° C. These comelts will be combined with any one or more of the listed metals to produce the autoignition reaction. Selected nitrates, chlorates, or perchlorates may also be added to augment ignition and output.

The autoignition composition of the invention is preferably placed within a gas generating or pyrotechnic device, e.g., within an inflator housing, where, when the inflator is exposed to flame or a high temperature environment, they operate in a manner that allows the autoignition composition to ignite and initiate combustion of the pyrotechnic charge of the device at a device temperature that is lower than the temperature at which the device loses mechanical integrity. As the operating pressure of standard pyrotechnics increases with increasing temperature, a gas generator composition at its autoignition temperature will produce an operating pressure that is too high for a pressure vessel that was designed for minimum weight. Moreover, the melting point of many non-azide gas generator compositions is low enough for the gas generator composition to be molten at the autoignition temperature of the composition, which can result in a loss of ballistic control and excessive operating pressures. Therefore, in a vehicle fire, the ignition of the gas generator composition can result in an explosion in which fragments of the inflation unit are propelled at dangerous and potentially lethal velocities. With the autoignition compositions of the present invention, the combustion of the main pyrotechnic charge is initiated at a temperature below the temperature at which the material used to form the shell or housing begins to weaken or soften, and the uncontrolled combustion of the gas generator or pyrotechnic composition at higher temperatures is prevented, which could otherwise result in an explosion of the device. Preferred locations within the gas generating or pyrotechnic device include a cup or recessed area at the bottom of the housing of the device, a coating or pellet affixed to the inner surface of the housing, or inclusion as part of the squib used to ignite the gas generator or pyrotechnic composition during normal operation.

The foregoing features, aspects and advantages of the present invention will become more apparent from the following non-limiting examples of the present invention.

EXAMPLES

The determination of temperatures of autoignition, thermal decomposition, melting, eutectics and peritectics, crystalline rearrangements, etc. was performed on a Perkin-Elmer DSC-7 differential scanning calorimeter. Scanning rates ranged from 0.1° C./min to 100° C./min. Due to heat transfer effects at higher scan rates, the most accurate results were obtained at the slower scan rates (0.1 to 1.0° C./min). It should be noted, however, that the faster scan rates (50 to 100° C./min) are more representative of bonfire type heating.

A number of the autoignition compositions display mass effects that can affect the autoignition temperature. For example, a 6 mg sample of $LiClO_4$/Mo will autoignite at 146° C. on the DSC (1° C./min scan rate). This autoignition occurs just after a crystalline phase transition. On the other hand, a 2 mg sample does not autoignite until 237° C., which is just before the melting point of $LiClO_4$ (248° C.). To address these mass effects on a larger scale and also to test application size samples, typically about 50 to about 250 grams, a tightly temperature controlled tube furnace is used. This also provides a practical means of determining time to autoignition at a selected temperature for various sample sizes ranging from about 50 to about 250 grams.

Example 1

$$6AgNO_3+6KNO_3+10Mo \rightarrow 3Ag_2O+3K_2O+10MoO_3+6N_2 \quad \text{(VI)}$$

An autoignition composition was prepared by mixing a comelt of equimolar amounts of silver nitrate ($AgNO_3$) and potassium nitrate ($KNO_3$) with a stoichiometric amount of a molybdenum (Mo) metal according to equation VI, i.e., 39.4% by weight $AgNO_3$, 23.5% by weight $KNO_3$, and 37.1% by weight Mo. An autoignition temperature of 135±1° C. was determined for the composition using differential scanning calorimetry (DSC) with 2 to 8 mg samples. However, when a 200 mg sample was tested in a tube furnace, the autoignition temperature was 130±2° C., demonstrating the existence of a mass effect.

There are two melting points and, therefore, two autoignition temperatures associated with this set of materials. A composition with a weight percent of $AgNO_3$ greater than 44.6% of the autoignition composition melts and autoignites at the eutectic at 118±2° C. However, with a weight percent of $AgNO_3$ of less than 44.6%, the composition melts and autoignites at the peritectic at 135±2° C.

Example 2

$$AgNO_2+AgNO_3+4Zn \rightarrow Ag_2O+4ZnO+N_2 \quad \text{(VII)}$$

A comelt of equimolar amounts of silver nitrite, $AgNO_2$, and silver nitrate, $AgNO_3$, was mixed with a stoichiometric amount of zinc, Zn, metal in accordance with equation VII, i.e., 26.3% by weight $AgNO_2$, 29.0% by weight $AgNO_3$, and 44.7% Zn. An autoignition temperature of 130±2° C. was determined for the composition using DSC.

Example 3

$$3AgNO_2+3AgNO_3+4Mo \rightarrow 3Ag_2O+4MoO_3+3N_2 \quad \text{(VIII)}$$

A comelt of equimolar amounts of $AgNO_2$ and $AgNO_3$ was mixed with a stoichiometric amount of Mo metal in accordance with equation VIII, i.e., 34.1% by weight $AgNO_2$, 37.6% by weight $AgNO_3$, and 28.3% by weight Mo. An autoignition temperature of 131±2° C. was determined for the composition using DSC.

Example 5

$$2AgNO_3+5Mg \rightarrow Ag_2O+5MgO+N_2 \quad \text{(X)}$$

$AgNO_3$ was mixed with a stoichiometric amount of magnesium, Mg, metal in accordance with equation X, i.e., 73.7% by weight $AgNO_3$ and 26.3% by weight Mg. An autoignition temperature of 157±2° C. was determined for the composition using DSC.

Example 6

$$KClO_4+2AgNO_3+9Mg \rightarrow 9MgO+Ag_2O+KCl+N_2 \quad \text{(XI)}$$

$AgNO_3$ was mixed with a stoichiometric amount of potassium perchlorat, $KClO_4$, and Mg in accordance with equation XI, i . . . , 19.9% by weight $KClO_4$, 48.7% by weight $AgNO_3$ and 31.4% by weight Mg. An autoignition temperature of 154±2° C. was determined for the composition using DSC.

It may be noted that the composition of example 5, $AgNO_3$/Mg, has about the same autoignition temperature, 157° vs 154° C., as the composition of example 6, $AgNO_3$/$KClO_4$/Mg. Accordingly, it might be concluded that the $AgNO_3$/Mg reaction is the driving force in both cases. However, the $AgNO_3$/$KClO_4$/Mg composition reacts with much greater energy than the $AgNO_3$/Mg composition. In general, perchlorates produce greater energy than nitrates in this type of reaction, and, thus, this example demonstrates output augmentation by $KClO_4$.

Example 7

$$6AgNO_3+6LiNO_3+10Mo \rightarrow 3Ag_2O+3Li_2O+10MoO_3+6N_2 \quad \text{(XII)}$$

A comelt of equimolar amounts of lithium nitrate, $LiNO_3$, and $AgNO_3$ was mixed with a stoichiometric amount of Mo metal, in accordance with equation XII, i.e., 17.3% by weight $LiNO_3$, 42.6% by weight $AgNO_3$ and 40.1% by weight Mo. An autoignition temperature of 175±2° C. was determined for the composition using DSC.

Example 8

$$2AgNO_3+2Ca(NO_3)_2+5Mo \rightarrow Ag_2O+2CaO+5MoO_3+3N_2 \quad \text{(XIII)}$$

A comelt of equimolar amounts of calcium nitrate, $Ca(NO_3)_2$), and $AgNO_3$ was mixed with a stoichiometric amount of Mo metal, in accordance with equation XIII, i.e., 28.6% by weight $Ca(NO_3)_2$, 29.6% by weight $AgNO_3$ and 41.8% by weight Mo. An autoignition temperature of 193±2° C. was determined for the composition using DSC.

The $Ca(NO_3)_2$ was received as $Ca(NO_3)_2 \cdot 4H_2O$ and was dried to remove the $H_2O$ before comelting.

Example 9

$$6AgNO_3+5Mo \rightarrow 3Ag_2O+5MoO_3+3N_2 \quad \text{(XIV)}$$

$AgNO_3$ was mixed with a stoichiometric amount of Mo in accordance with equation XIV, i.e., 68.0% by weight $AgNO_3$ and 32.0% by weight Mo. This composition autoignited at 199±2° C. by DSC analysis.

Example 10

$$KClO_4+2AgNO_3+3Mo \rightarrow 3MoO_3+Ag_2O+KCl+N_2 \quad \text{(XV)}$$

$AgNO_3$ was mixed with a stoichiometric amount of $KClO_4$ and Mo in accordance with equation XV, i.e., 18.1% by weight $KClO_4$, 44.3% by weight $AgNO_3$ and 37.6% by weight Mo. The composition autoignited at 192±2° C. as determined by DSC analysis.

As with the $AgNO_3$/Mg and $KClO_4$/$AgNO_3$/Mg, described above, $AgNO_3$/Mo autoignites at nearly the same temperature, 199° C. vs 192° C., as the $KClO_4$/$AgNO_3$/MO. However, the $KClO_4$/$AgNO_3$/Mo system autoignites with greater energy than the $AgNO_3$/MO, and is another example of output augmentation by $KClO_4$.

Example 11

$$6AgNO_3+6NaNO_3+10Mo \rightarrow 3Ag_2O+3Na_2O+10MoO_3+6N_2 \quad \text{(XVI)}$$

A comelt of an equimolar ratio of $AgNO_3$ and sodium nitrate, $NaNO_3$, was mixed with a stoichiometric amount of Mo metal in accordance with equation XVI, i.e., 20.5% by weight $NaNO_3$, 41.0% by weight $AgNO_3$ and 38.5% by weight Mo. The composition autoignited at 217±2° C. by DSC analysis.

Example 13

$$CH_6N_4O_3+2AgNO_3+Mo \rightarrow MoO_3+3N_2+CO_2+3H_2O+Ag_2O \quad \text{(XIX)}$$

A 1:2 ratio of guanidine nitrate to $AgNO_3$ was mixed with a stoichiometric amount of Mo in accordance with equation XIX, i.e., 21.9% by weight $CH_6N_4O_3$, 60.9% $AgNO_3$ and 17.2% by weight Mo. The composition autoignited at 172±2° C. (by DSC).

This composition is also an example of organic nitrates in autoignition reactions. However, this composition is fully oxidized, and, therefore, requires no external source of oxygen.

Mass effects have been observed with this composition. For 2 to 8 mg samples, DSC autoignition temperatures between 170 and 174° C. were observed. Mass, thermal and possibly self-heating/catalytic effects become evident when larger samples, i.e., 50 to 250 mg, are heated in a tightly temperature controlled tube furnace. Autoignition temperatures ranging from 128 to 158° C. have been produced in the tube furnace with 200 mg samples of various $CH_6N_4O_3$/$AgNO_3$/Mo compositions in both powder and pellet form. The autoignition temperature for $CH_6N_4O_3$/$AgNO_3$/Mo compositions can be tailored by adjusting the molybdenum metal content from stoichiometrically balanced to extremely fuel (metal) rich. As the molybdenum metal content is increased the autoignition temperature decreases. The following balanced equations represent a progression from a fully oxidized $CH_6N_4O_3$/$AgNO_3$/Mo system through increasingly under oxidized or fuel rich systems.

$$CH_6N_4O_3+2AgNO_3+Mo \rightarrow MoO_3+Ag_2O+3N_2+CO_2+3H_2O \quad \text{(XX)}$$

$$6CH_6N_4O_3+10AgNO_3+6Mo \rightarrow 6MoO_3+10Ag+17N_2+6CO_2+18H_2O \quad \text{(XXI)}$$

$$3CH_6N_4O_3+4AgNO_3+3Mo \rightarrow 3MoO_2+4Ag+8N_2+3CO_2+9H_2O \quad \text{(XXII)}$$

$$6CH_6N_4O_3+6AgNO_3+10Mo \rightarrow 10MoO_2+6Ag+15N_2+6CO+10H_2O+8H_2 \quad \text{(XXIII)}$$

$$2CH_6N_4O_3+2AgNO_3+4Mo \rightarrow 4MoO_2+2Ag+5N_2+2CO+2H_2O+4H_2 \quad \text{(XXIV)}$$

Amounts of molybdenum metal added in excess of the stoichiometric amount given in equation XX will produce thermal and possibly catalytic effects which further reduce the autoignition temperature.

Example 14

$$4N(CH_3)_4NO_3+4CN_5H_3+19KClO_3+10\ Mo \rightarrow 14N_2+15CO+5CO_2+14H_2O+16H_2+10MoO_3+19KCl \quad \text{(XXV)}$$

Tetramethyl ammonium nitrate, $N(CH_3)_4NO_3$, was mixed with 5-aminotetrazole, $CN_5H_3$, potassium chlorate, $KClO_3$, and molybdenum, Mo, in accordance with equation XXV, i.e., 11.8% by weight $N(CH_3)_4NO_3$, 8.2% by weight $CN_5H_3$, 56.7% by weight $KClO_3$, and 23.3% by weight Mo. An autoignition temperature of 155±2° C. was determined for this composition using DSC analysis. The 5-aminotetrazole used should be anhydrous.

Example 15

$$2N(CH_3)_4NO_3+2CN_5H_3+7KClO_4+5Mo \rightarrow 7N_2+7CO+3CO_2+6H_2O+9H_2+5MoO_3+7KCl \quad \text{(XXVI)}$$

Tetramethyl ammonium nitrate, $N(CH_3)_4NO_3$, was mixed with 5-aminotetrazole, $CN_5H_3$, potassium perchlorate, $KClO_4$, and molybdenum, Mo, in accordance with equation XXVI, i.e., 13.1% by weight $N(CH_3)_4NO_3$, 9.1% by weight $CN_5H_3$, 52.1% by weight $KClO_4$, and 25.7% by weight Mo. An autoignition temperature of 170±3° C. was determined for this composition by DSC analysis. The 5-aminotetrazole used should be anhydrous.

The invention has also been successfully tested in timed autoignition tests at various temperatures, and in bonfire tests in prototype automobile air bag inflators.

While it is apparent that the disclosed invention is well calculated to fulfill the objectives stated above, it will be appreciated that numerous modifications and embodiments may be devised by those skilled in the art, and it is intended that the appended claims cover all such modifications and embodiments that fall within the true spirit and scope of the present invention.

We claim:

1. A low temperature autoignition composition for safely initiating combustion of a main pyrotechnic charge in a gas generator or pyrotechnic device exposed to flame or a high temperature environment, consisting essentially of:

a mixture of a silver nitrate oxidizer composition and a powdered metal fuel, the silver nitrate oxidizer composition consisting essentially of one of:

(a) silver nitrate; or (b) a comelt or mixture consisting essentially of silver nitrate and at least one additional component selected from the group consisting of an alkali metal nitrate, an alkaline earth metal nitrate, a complex salt nitrate, a dried hydrated nitrate, an alkali metal chlorate, an alkali metal perchlorate, an alkaline earth metal chlorate, an alkaline earth metal perchlorate, ammonium perchlorate, sodium nitrite, potassium nitrite, silver nitrite, a complex salt nitrite, a solid organic nitrate, and a solid organic nitrite;

wherein the powdered metal fuel is selected from the group consisting of molybdenum, calcium, strontium, barium, titanium, zirconium, vanadium, niobium, tantalum, chromium, tungsten, manganese, iron, cobalt, nickel, copper, zinc, cadmium, tin, antimony, bismuth, aluminum, silicon, and mixtures thereof;

the silver nitrate oxidizer composition has at least one of a crystalline phase transition, a melting point, a eutectic point, or a peritectic point at a temperature of no more than about 250° C.;

the metal fuel is present in an amount at least substantially stoichiometric relative to the silver nitrate oxidizer composition; and the mixture of metal fuel and silver nitrate oxidizer composition has a mix intimacy and homogeneity sufficient between the silver nitrate oxidizer composition and the metal fuel to react in an autoignition reaction of metal fuel and silver nitrate oxidizer composition at an autoignition temperature of no more than about 232° C., thereby providing an autoignition composition having the autoignition temperature of no more than about 232° C.; wherein heating the autoignition composition to the autoignition temperature results in a reaction between the silver nitrate and the metal fuel, thereby initiating the autoignition reaction.

2. The low temperature autoignition composition of claim 1, wherein the silver nitrate oxidizer composition is a comelt consisting essentially of silver nitrate and at least one of an alkali metal nitrate, alkali metal nitrite, alkali metal chlorate, alkali metal perchlorate, alkaline metal nitrate, alkaline metal nitrite, alkaline metal chlorate, alkaline metal perchlorate, sodium nitrite, potassium nitrite, or silver nitrite.

3. The low temperature autoignition composition of claim 2, wherein the powdered metal fuel is selected from the group consisting of molybdenum, titanium, zirconium, niobium, nickel, chromium, zinc, aluminum, and cerium.

4. The low temperature autoignition composition of claim 3, wherein the powdered metal fuel is selected from the group consisting of molybdenum, titanium, zirconium, zinc, and cerium.

5. The low temperature autoignition composition of claim 4, wherein the powdered metal fuel is molybdenum.

6. The low temperature autoignition composition of claim 4, wherein the silver nitrate oxidizer composition is selected from the group consisting of silver nitrate and comelts consisting essentially of silver nitrate and potassium nitrate, silver nitrate and sodium nitrate, and silver nitrate and lithium nitrate.

7. The low temperature autoignition composition of claim 4, wherein the silver nitrate oxidizer composition is a comelt consisting essentially of silver nitrate and potassium nitrate.

8. The low temperature autoignition composition of claim 6, wherein the powdered metal fuel is molybdenum.

9. The low temperature autoignition composition of claim 8, wherein the comelt is ground to a particle size of about 10 to about 30 microns, and the molybdenum powder has a particle size of less than about 6 microns.

10. The low temperature autoignition composition of claim 6, wherein the mole fraction of silver nitrate in the comelt is about 0.4 to about 0.6;

the mole fraction of potassium nitrate in the comelt is about 0.6 to 0.4; and the comelt is mixed with at least a stoichiometric amount of molybdenum powder fuel.

11. The low temperature autoignition composition of claim 10, wherein the autoignition temperature is about 130–135° C.

12. The low temperature autoignition composition of claim 1, wherein the silver nitrate oxidizer composition consists essentially of a mixture of silver nitrate and a solid organic nitrate or a solid organic nitrite.

13. The low temperature autoignition composition of claim 12, wherein the silver nitrate oxidizer composition consists essentially of a mixture of silver nitrate and guanidine nitrate.

14. The low temperature autoignition composition of claim 12, wherein the powdered metal fuel is selected from the group consisting of molybdenum, titanium, zirconium, niobium, nickel, chromium, zinc, aluminum, and cerium.

15. The low temperature autoignition composition of claim 12, wherein the powdered metal fuel is selected fuel from the group consisting of molybdenum, titanium, zirconium, zinc, and cerium.

16. The low temperature autoignition composition of claim 12, wherein the powdered metal fuel is molybdenum.

17. The low temperature autoignition composition of claim 16, wherein the molybdenum fuel is present in an amount greater than that required to form a mixture in which the amount of molybdenum fuel is stoichiometric relative to the silver nitrate oxidizer composition, thereby providing an autoignition composition having an autoignition temperature that is less than the autoignition temperature of a similar composition in which the amount of molybdenum fuel is stoichiometric relative to the silver nitrate oxidizer composition.

18. The low temperature autoignition composition of claim 1, further consisting essentially of an alkali metal chloride, alkali metal fluoride, alkali metal bromide, alkaline earth metal chloride, alkaline earth metal fluoride, or alkaline earth metal bromide.

19. The low temperature autoignition composition of claim 1, further consisting essentially of an output augmenting composition, consisting essentially of a metal in combination with an energetic oxidizer selected from the group consisting of ammonium perchlorate, alkali metal chlorates, alkali metal perchlorates, and alkali metal nitrates.

20. The low temperature autoignition composition of claim 1, wherein the silver nitrate oxidizer composition consists essentially of silver nitrate and a complex salt nitrate of at least one of $Ce(NH_4)_2(NO_3)_6$ and $ZrO(NO_3)_2$.

21. The low temperature autoignition composition of claim 1, wherein the silver nitrate oxidizer composition consists essentially of silver nitrate and a dried hydrated metal nitrate of $Ca(NO_3)_2 \cdot 4H_2O$ or $Cu(NO_3)_2 \cdot 2.5H_2O$.

22. The low temperature autoignition composition of claim 1, further consisting essentially of a metal oxide catalyst.

23. The low temperature autoignition composition of claim 22, wherein the metal oxide catalyst is selected from the group consisting of $Al_2O_3$, $SiO_2$, $CeO_2$, $V_2O_5$, $CrO_3$, $Cr_2O_3$, $MnO_2$, $Fe_2O_3$, $CO_3O_4$, NiO, CuO, ZnO, $ZrO_2$, $Nb_2O_5$, $MoO_3$, and $Ag_2O$.

24. The low temperature autoignition composition of claim 1, wherein the fuel consists essentially of molybdenum and the silver nitrate oxidizer composition consists essentially of a mixture of silver nitrate, potassium nitrate, and guanidine nitrate.

25. A low temperature autoignition composition for safely initiating combustion of a main pyrotechnic charge in a gas generator or pyrotechnic device exposed to flame or a high temperature environment comprising:

a mixture of a silver nitrate oxidizer composition and a powdered metal fuel; wherein the silver nitrate oxidizer composition comprises a mixture or a comelt comprising silver nitrate and at least one additional component selected from the group consisting of an alkali metal nitrate, an alkaline earth metal nitrate, a complex salt nitrate, a dried hydrated nitrate, silver nitrate, an alkali metal chlorate, an alkali metal perchlorate, an alkaline earth metal chlorate, an alkaline earth metal perchlorate, ammonium perchlorate, sodium nitrite, potassium nitrite, silver nitrite, a complex salt nitrite, a solid organic nitrate, and a solid organic nitrite;

the metal fuel is present in an amount at least substantially stoichiometric relative to the silver nitrate oxidizer composition; and the mixture of metal fuel and silver nitrate oxidizer composition has a mix intimacy and homogeneity sufficient in the composition between the silver nitrate oxidizer composition and the metal fuel to react in an autoignition reaction of metal fuel and silver nitrate oxidizer composition at an autoignition temperature of no more than about 232° C., thereby providing an autoignition composition having the autoignition temperature of no more than about 232° C.; wherein heating the autoignition composition to the autoignition temperature results in a reaction between silver nitrate and the metal fuel, thereby initiating the autoignition reaction.

26. The low temperature autoignition composition of claim 25, wherein the metal fuel is present in an amount sufficient to form a fuel rich composition, thereby providing an autoignition composition having an autoignition temperature that is less than the autoignition temperature of a similar composition having a stoichiometric amount of metal fuel.

27. The low temperature autoignition composition of claim 26, wherein the powdered metal fuel is chosen form the group consisting of molybdenum, magnesium, calcium, strontium, barium, titanium, zirconium, vanadium, niobium, tantalum, chromium, tungsten, manganese, iron, cobalt, nickel, copper, zinc, cadmium, tin, antimony, bismuth, aluminum, and silicon.

28. The low temperature autoignition composition of claim 26, wherein the fuel comprises molybdenum and the silver nitrate oxidizer composition comprises silver nitrate, potassium nitrate, and guanidine nitrate.

29. The low temperature autoignition composition of claim 1, further consisting essentially of a solid organic amine.

30. The low temperature autoignition composition of claim 12, further consisting essentially of a solid organic amine.

31. The low temperature autoignition composition of claim 25, further comprising a solid organic amine.

* * * * *